US010407140B2

(12) United States Patent
Young

(10) Patent No.: US 10,407,140 B2
(45) Date of Patent: Sep. 10, 2019

(54) PADDLEBOARD RUDDER CONTROL SYSTEM

(71) Applicant: Douglas H. Young, Vernon, CT (US)

(72) Inventor: Douglas H. Young, Vernon, CT (US)

( * ) Notice: Subject to any disclaimer, the term of this patent is extended or adjusted under 35 U.S.C. 154(b) by 0 days.

(21) Appl. No.: 15/839,141

(22) Filed: Dec. 12, 2017

(65) Prior Publication Data

US 2018/0201346 A1 Jul. 19, 2018

Related U.S. Application Data

(60) Provisional application No. 62/447,494, filed on Jan. 18, 2017.

(51) Int. Cl.
*B63B 35/79* (2006.01)
*B63H 25/38* (2006.01)

(52) U.S. Cl.
CPC ..... *B63B 35/7926* (2013.01); *B63H 25/38* (2013.01)

(58) Field of Classification Search
CPC ..... B63B 35/7926; B63H 25/38
See application file for complete search history.

(56) References Cited

U.S. PATENT DOCUMENTS 4,911,664 A * 3/1990 Gremillion ..... B63H 5/165 416/146 R
5,183,333 A 2/1993 Minowa
5,555,837 A 9/1996 Marshall
6,054,831 A * 4/2000 Moore ..... B63H 20/007 114/144 R
6,213,044 B1 * 4/2001 Rodgers ..... B63B 35/793 114/152
7,568,443 B2 8/2009 Walker
8,306,673 B1 * 11/2012 Manning ..... A63C 17/12 280/87.041
9,248,890 B2 2/2016 Raaphorst
9,527,457 B2 * 12/2016 Gasparro ..... B60R 11/04
2003/0167991 A1 9/2003 Namanny
2011/0090148 A1 * 4/2011 Li ..... G06F 1/163 345/158
2011/0212691 A1 9/2011 Rott
2012/0100767 A1 * 4/2012 McCredie ..... B63B 35/793 441/79
2014/0134900 A1 5/2014 Derrah
2015/0191227 A1 7/2015 Addison
2015/0314847 A1 11/2015 La Rovere
2015/0336649 A1 11/2015 Radenbaugh

OTHER PUBLICATIONS

Sic Maui; Sic Intorduces F.A.S.T.—Foot Actuated Steering Technology; Jun. 30, 2016; http://sicmaui.com/blog/sic-introduces-fast-foot-actuated-steering-technology/.

* cited by examiner

*Primary Examiner* — Anthony D Wiest
(74) *Attorney, Agent, or Firm* — Michael A. Blake

(57) ABSTRACT

A paddleboard rudder control system comprising: an attachment means, the attachment means comprising; a tooth configured to slide into a fin box of a paddleboard; a plurality of fasteners configured to attach the attachment means to a bottom of the paddleboard when the tooth is slid within the fin box of the paddleboard; a rudder motor housing removably attached to the attachment means; a rudder motor located within the rudder motor housing; and a rudder in rotatable communication with the rudder motor.

8 Claims, 7 Drawing Sheets

PADDLEBOARD RUDDER CONTROL SYSTEM

CROSS-REFERENCES

This patent application claims the benefit of U.S. Provisional Patent Application No. 62/447,494 by inventor Douglas H. Young entitled "PADDLEBOARD RUDDER SYSTEM," filed on Jan. 18, 2017, and which provisional application is fully incorporated by reference herein.

TECHNICAL FIELD

The present invention relates to a rudder system for a standup paddleboard, and more specifically to a removable rudder system for a standup paddle board that can be operated with a remote hand control.

BACKGROUND

Standup Paddleboards ("SUPs") have become an extremely popular watersport for both recreation and fitness. The slower speeds involved and the position of the user in the center of the SUP can make it difficult to turn quickly or sharply to avoid obstacles. As SUPs have a very shallow draft and the user is standing upright, SUPs are also very easily influenced by even light winds, making turning into the wind or maintaining a straight course very difficult. This can make SUP use on a windy day very frustrating and in some situations dangerous. Also, as one of the top reasons cited for participating in standup paddleboarding is fitness, paddling when wind is present leads to excessive paddling on one side in order to maintain a desired course, resulting in an unbalanced workout and even risk of repetitive motion injury. A way to more effectively steer a SUP in obstacle prone areas or in windy conditions would be highly desirable.

Currently one SUP manufacturer offers a built-in rudder system where the rudder is manipulated via a foot-actuated lever applying force to the rudder via cables running through channels incorporated into the interior of the board. Thus current integrated rudder systems require the user to manipulate a lever with a foot, necessitating the user to either stay fixed in one location on the board or change from a more desirable position in order to actuate the lever. This brand of SUP is at the high end of price point—two to three times the cost of other popular brands—and typically used only by very serious or competitive paddleboarders. The rudder systems adds significantly to the cost of the board. Again, these boards are much more expensive than the boards commonly used by the majority of recreational or fitness SUP users. There currently exists no rudder solution that can be easily and economically used on any SUP, and is removable and portable for use on multiple boards by the user.

Thus there is a need for a paddleboard rudder control system that overcomes the above listed and other disadvantages.

SUMMARY OF THE INVENTION

The disclosed invention relates to a paddleboard rudder control system comprising: an attachment means, the attachment means comprising; a tooth configured to slide into a fin box of a paddleboard; a plurality of fasteners configured to attach the attachment means to a bottom of the paddleboard when the tooth is slid within the fin box of the paddleboard; a rudder motor housing removably attached to the attachment means; a rudder motor located within the rudder motor housing; and a rudder in rotatable communication with the rudder motor.

In addition, the invention relates to a paddleboard rudder controller comprising: a controller housing, the controller housing configured to be removably attached to a user; a first direction button located on the exterior of the controller housing; a second direction button located on the exterior of the controller housing; a controller circuit board located within the controller housing, and in signal communication with the first direction button and the second direction button; a transmitter located within the controller housing and in signal communication with the controller circuit board and with a receiver located within a rudder motor housing; and a battery located within the controller housing and in operable communication with the controller circuit board.

The invention also relates to a rudder control system for a watercraft comprising: an attachment means, the attachment means comprising; a tooth configured to slide into a fin box of a watercraft; a plurality of fasteners configured to attach the attachment means to a bottom of the watercraft when the tooth is slid within the fin box of the watercraft; a rudder motor housing removably attached to the attachment means; a rudder motor located within the rudder motor housing; and a rudder in rotatable communication with the rudder motor.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

The paddleboard rudder control system may comprise a molded exterior case (plastic, ABS, etc.) with a watertight compartment on one end housing a battery pack, servo, remote control radio receiver, and controller circuit board. In one embodiment, via a servo rod and cam, the servo controls a stainless steel rudder shaft protruding perpendicularly from the bottom of the watertight compartment, attached to the bottom of the shaft is a rudder blade (plastic, ABS, etc.), which can be adjusted up and down the shaft to optimally position the rudder's depth for different thicknesses of boards. On the other end of the molded exterior case are a variety of slots and holes upon and through which a bolt with a hooked end may be inserted and hooked on an existing attachment point standard on most standup paddleboards and commonly referred to as a "leash plug" or "tether plug", and subsequently tightened down via means of hand turning a large molded nut, causing the molded case to be drawn down tightly onto the board's top rear surface. An arrangement of slip-resistant gripping pads on the underneath side of the molded case are in contact with the board's surface, preventing both slippage and marring of the board's finish. An add-on bracket with lever-action suction devices can be used to mount the case to boards not having a leash plug installed. A remote-controller is strapped or clamped to the paddle near the top grip and consists of a small waterproof case containing a coin-cell battery, a remote controller radio transmitter, a switch controller circuit board, and a switch that can be manipulated with the thumb or finger (depending on where positioned on the paddle) to turn the rudder right, left, and return to center. One possible feature is a bluetooth receiver that could be added to the device to allow a GPS app on a smartphone to automatically steer to maintain a specified course. Another possible feature is using a voice control means to control the rudder. In another embodiment, the remote controller may be removably attached to a user's wrist or forearm. In another embodiment, the paddleboard rudder control system may comprise a geared motor instead of a servo.

Figure 1:
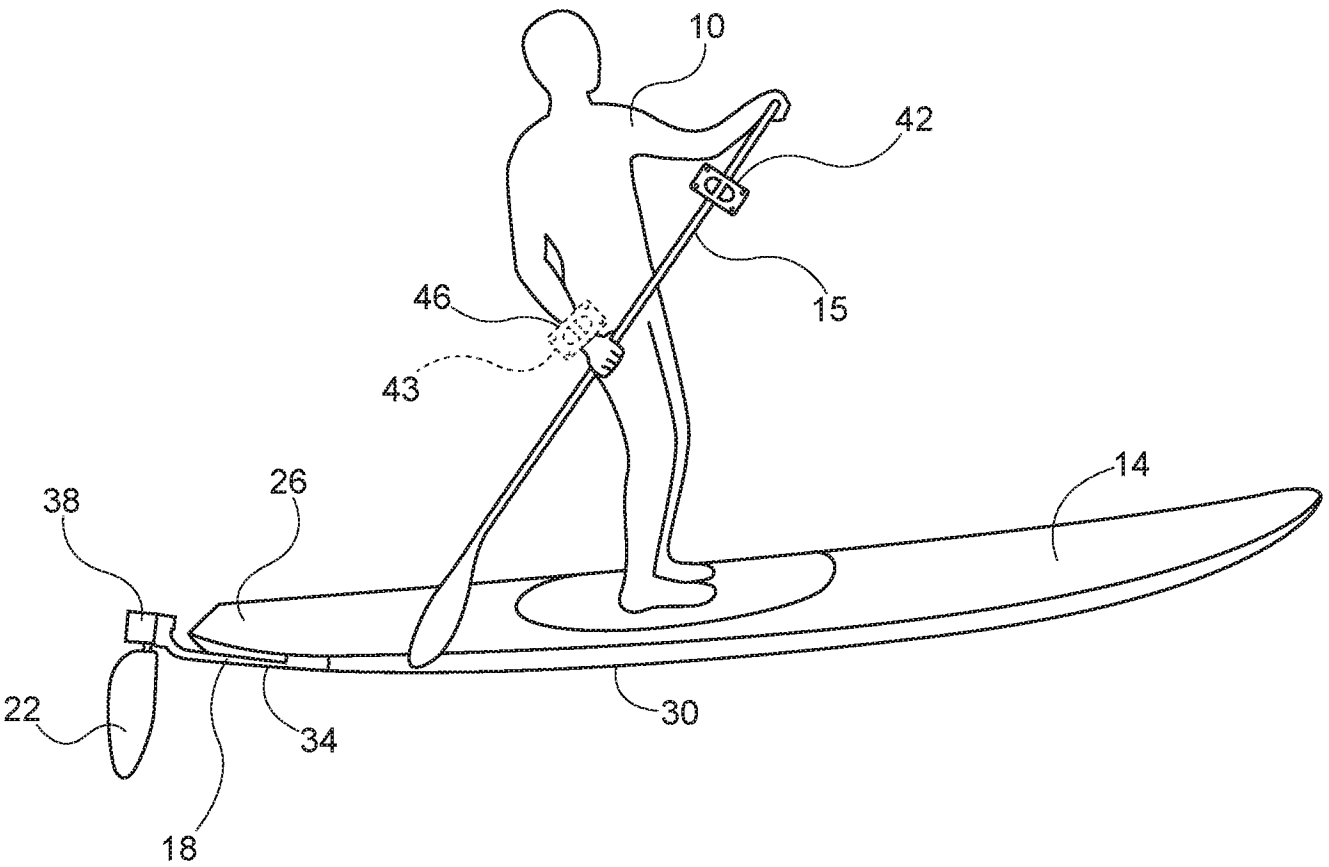
FIG. 1 is a perspective view of the disclosed paddleboard rudder control system in use.

FIG. 1 shows a user 10 on a paddleboard 14 with a rudder system 18 attached to the paddleboard 10. The rudder system 18 comprises a rudder 22 which extends off the back end 26 of the paddleboard 10. The rudder 22 is attached to the bottom 30 of the paddleboard 10 via an attachment means 34. The rudder system 18 comprises a rudder motor housing 38 which may contain a motor that is configured to rotate the rudder 22. A paddleboard rudder control system comprises the rudder system 18 and a controller 42 that may be removably attachable to a paddle 15. In another embodiment, the controller 43 may be attached to a user's wrist 46 or forearm.

Figure 2:
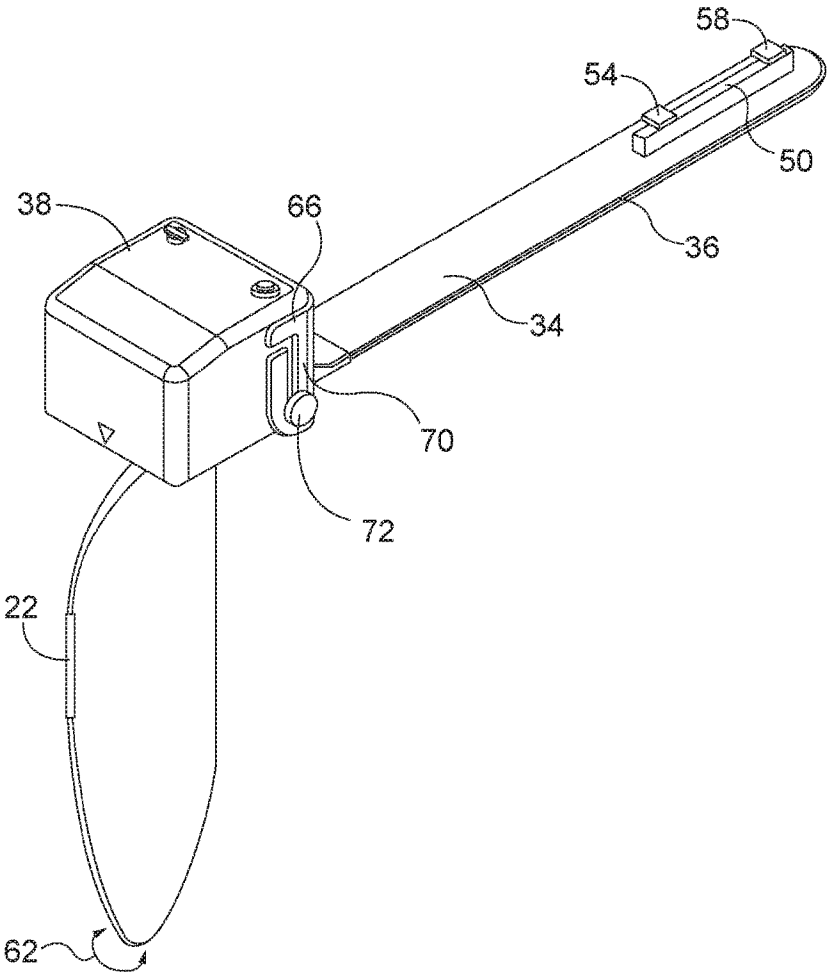
FIG. 2 is a close up perspective view of the rudder system.

FIG. 2 shows a close up perspective view of the rudder 22. The rudder is rotatably attached to the rudder motor housing 38. The housing is removably attached to the attachment means 34. In this embodiment, the attachment means is an elongated member 36 with an upwardly projected tooth 50. A first screw 52 (not visible in this view) slides into the bottom of the elongated member 36 and into the tooth 50 and exits the top of the tooth 50 where it engages with a first washer 54. Similarly a second screw 56 (not visible in this view) slides into the bottom of the elongated member 36 and into the tooth 50 and exits the top of the tooth 50 where it engages with a second washer 58. The rudder 22 may rotate in the direction of the arrow 62. The rudder motor housing 38 may be attached to the elongated member 36 via a slotted bracket 66 fixedly attached to the elongated member 36. The bracket 66 may have one or more slots 70. The slots 70 may comprise a horizontal portion and a vertical portion. The rudder motor housing 38 may have a pin 72 that slides over the slot 70 and which pin is configured to hold the rudder motor housing 38 stationary with respect to the bracket 66. A release lever 74 (not visible in this view) allows one to release the rudder motor housing 38 from the bracket 66. The rudder motor housing 38, which contains a motor and battery, may be easily recharged when removed from the paddleboard 14. The rudder motor housing 38, will also house circuit board in signal communication with the motor. In addition the rudder motor housing 38 may also house a radio receiver in signal communication with the controller circuit board. The controller circuit board may have a failsafe such that if there is a low battery condition, the rudder 22 goes back to center (i.e. the rudder is lined up with the direction of the paddleboard).

Figure 3:
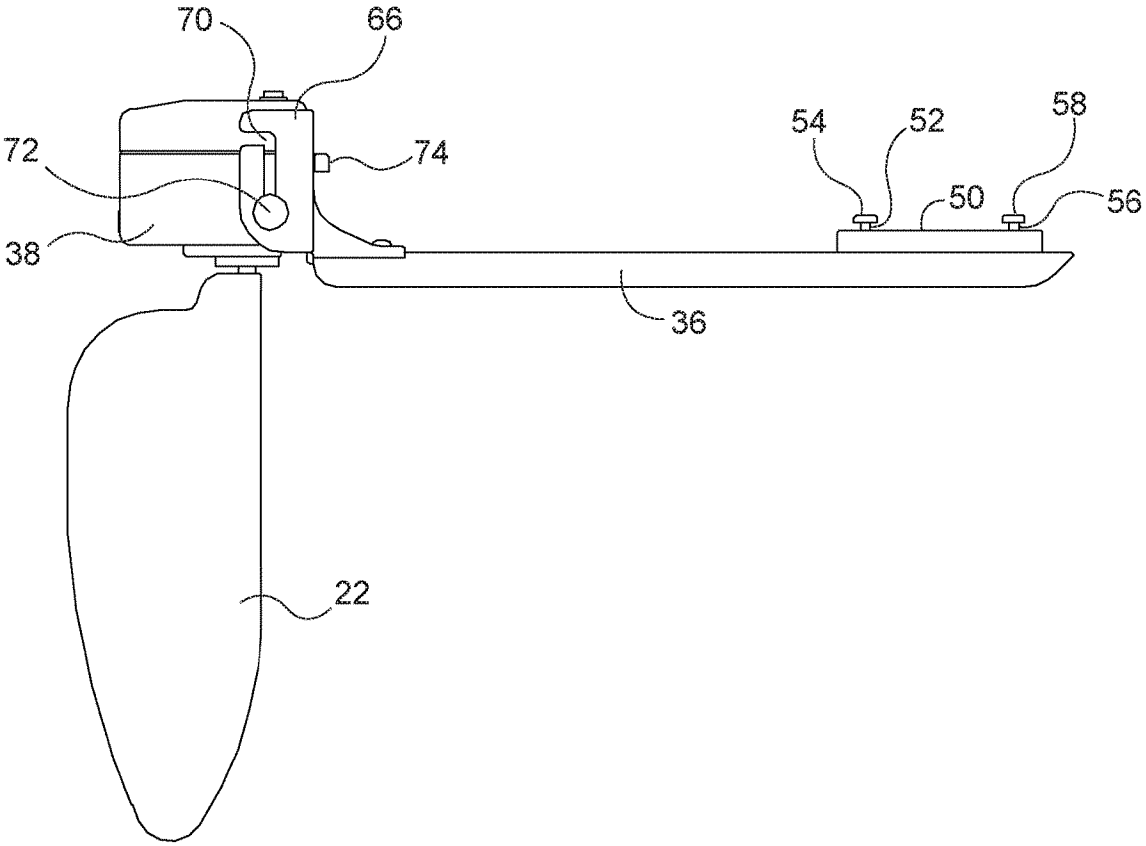
FIG. 3 is a side view of the rudder system.

FIG. 3 is a side view of the rudder 22, rudder motor housing 38, and elongated member 36. In this view, the tooth 50 can be more clearly seen extending upward from the elongated member 36.

Figure 4:
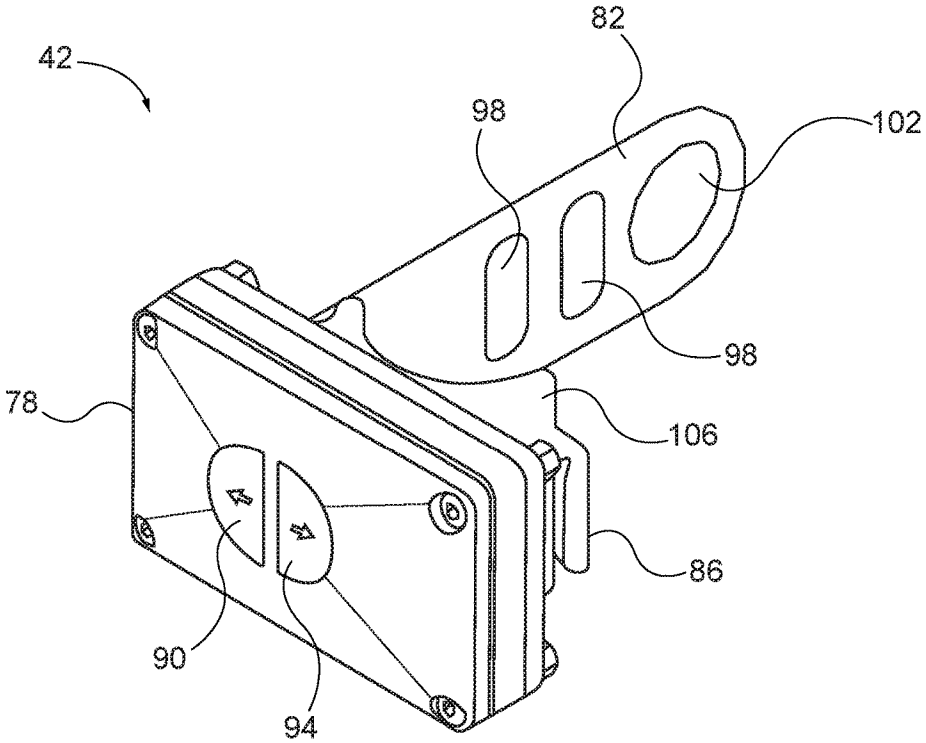
FIG. 4 is a perspective view of the controller.

FIG. 4 is a perspective view of the controller 42. The controller 42 comprises a controller housing 78, a strap 82, and a strap hook 86. The housing 78 has a first direction button 90 and a second direction button 94. The strap comprises a plurality of hook slots 98, and an opening 102. The housing 78 houses a battery, circuit board, and a transmitter. The buttons 90, 94 are in signal communication with the circuit board. The transmitter is in signal communication with the receiver located in the rudder motor housing 38. The strap 82 is configured to be wrapped around the handle or shaft of a paddle 15, a user's wrist or forearm, and one of the hook slots 98 is attached to the hook 86. The opening 102 is available to help the user grip and pull the strap around her wrist and attach the strap 82 to the hook 86. The housing 78 may have a curved portion 106 configured to generally fit about the handle or shaft of a paddle 15, or the wrist or forearm of a user. When one of the buttons 90, 94 are pressed, a signal is sent to the motor to rotate the rudder 22 in the direction associated with the button 90, 94. Generally the longer the button 90, 94 is held, the more the rudder 22 rotates. The strap may be made out of any suitable material, including but not limited to rubber, plastic, fabric, etc.

Figure 5:
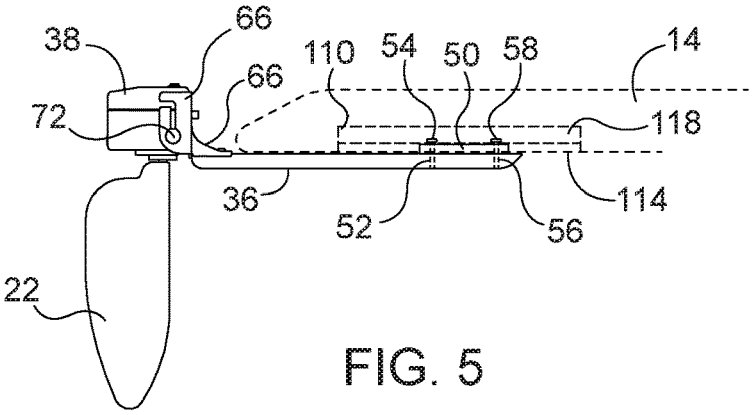
FIG. 5 is a side view of the rudder system installed on a paddleboard.

FIG. 5 is a side view of the rudder 22, rudder motor housing 38, elongated member 36, and a see-through view through the paddleboard 14. In this view the fin box 110 can be seen. The fin box is the opening located at the bottom of most paddleboards, where a fin can be attached to the paddleboard. The disclosed attachment means 34 is configured to attach to the fin box 110. The fin box 110 generally comprises a narrow slot 114, that will accept the tooth 50, and a wider portion 118 that can hold the wider washers 54, 58. Thus, when the screws 52, 56 are tightened, the washers and tooth 50 are pulled tight against the wider portion 118 just above the slot 114, holding the elongated member in position against the bottom of the paddleboard 14.

Figure 6:
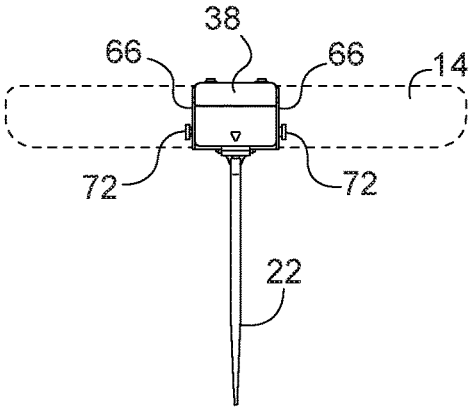
FIG. 6 is a rear view of the rudder system from FIG. 5.

FIG. 6 is a rear view of the rudder 22, rudder motor housing 38, and a see-through view through the paddleboard 14.

Figure 7:
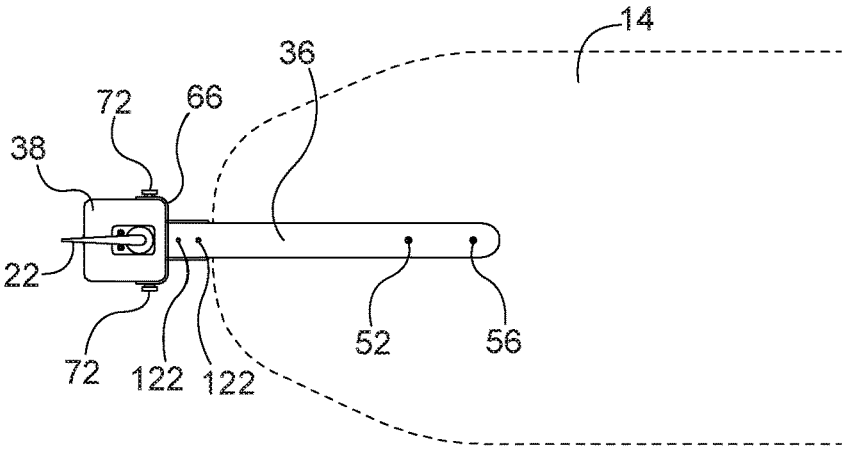
FIG. 7 is a bottom view of the rudder system from FIG. 5.

FIG. 7 is a bottom view of the rudder 22, rudder motor housing 38, elongated member 36, and a see-through view through the paddleboard 14. In this view, one embodiment of how the bracket 66 is attached to the elongated member 36 is shown. In this embodiment, the bracket 66 may be attached to the elongated member 36 via two or more screws 122.

Figure 8:
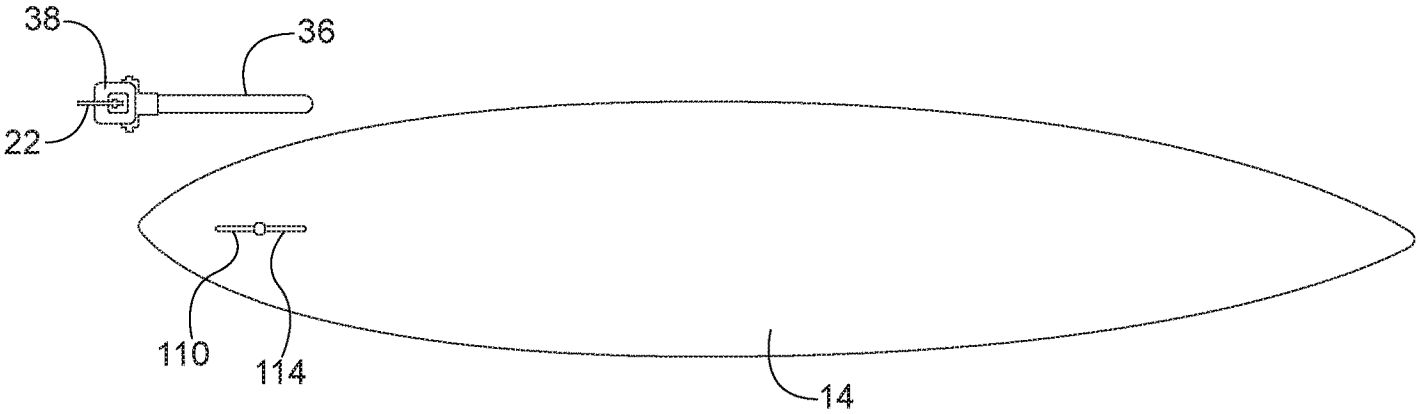
FIG. 8 is a bottom view of a paddleboard with the rudder system adjacent to the paddleboard.

FIG. 8 is a view of a bottom of a paddleboard 14 with the rudder 22, rudder motor housing 38, elongated member 36 adjacent to the paddleboard 14.

Figure 9:
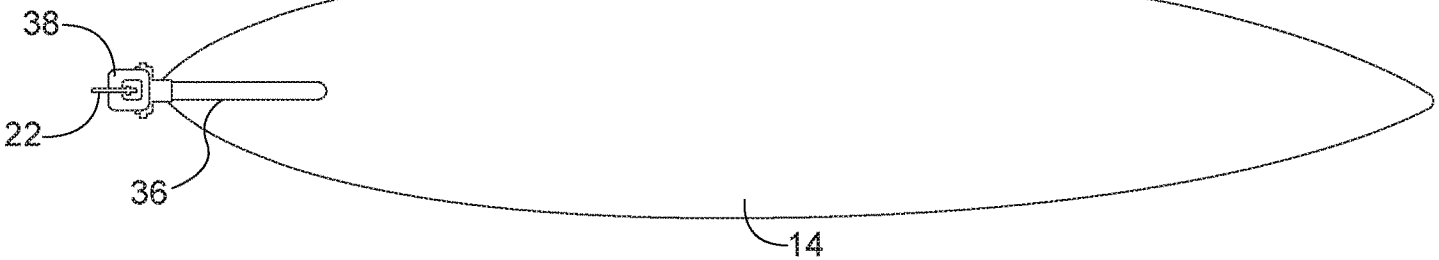
FIG. 9 is a bottom view of a paddleboard with the rudder system attached to the bottom of the paddleboard.

FIG. 9 is a view of a bottom of a paddleboard 14 with the rudder 22, rudder motor housing 38, elongated member 36 installed in the fin box 110.

Figure 10:
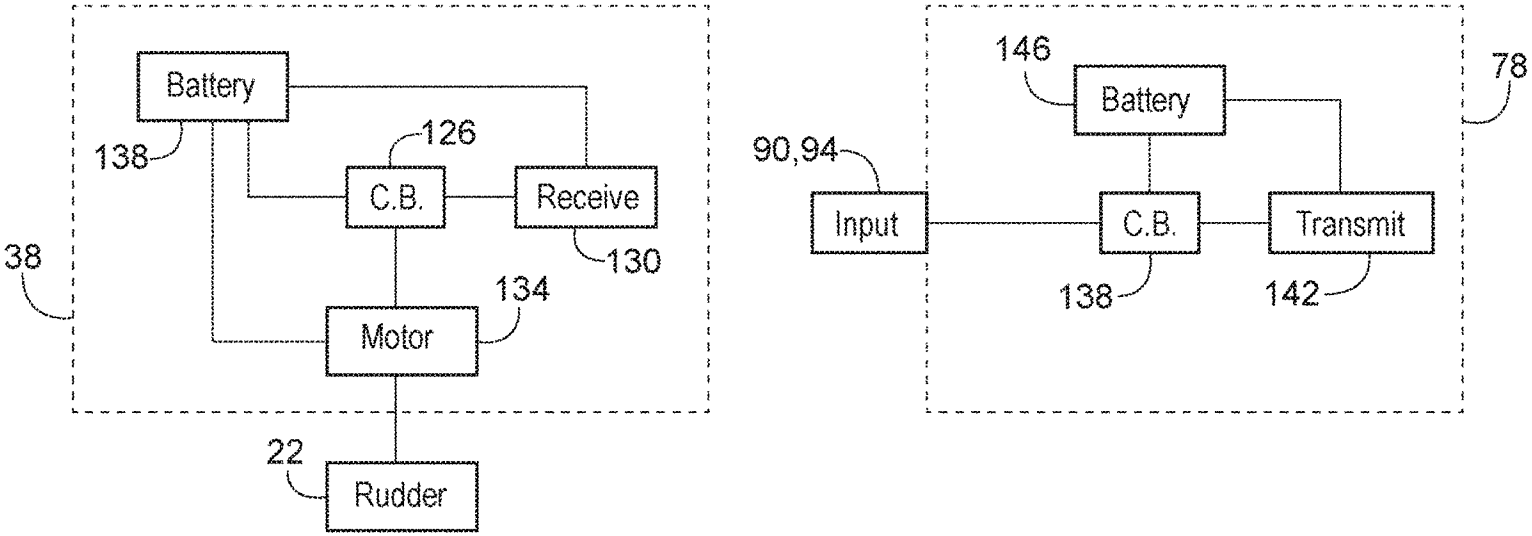
FIG. 10 is a schematic view of the paddleboard rudder control system.

FIG. 10 is a schematic diagram of the paddleboard rudder control system. Housed within the rudder motor housing 38 is a circuit board 126 in signal communication with a receiver 130 and a motor 134. Also housed in the rudder motor housing 38 is a battery 138 in operable communication with the circuit board 126, receiver 130, and motor 134. Housed within the controller housing 78 is a controller circuit board 138 in signal communication with the input 90, 94 (the buttons 90, 94) and in signal communication with the transmitter 142. Also housed in the controller housing 78 is a battery 146, the battery 146 may be in operable communication with the controller circuit board 138 and the transmitter 142. The transmitter 142 will be in signal communication with the receiver 130 when the system is in operation.

The invention is portable and can be easily attached to most any commonly available paddleboard and does not require changes in manufacturing or after-market modifications. As many paddleboard enthusiasts have multiple paddleboards and also frequently rent paddleboards when traveling, portability is a great convenience advantage. The lower cost and adaptability of the invention also allow owners of ubiquitous low to mid-priced paddleboards to enjoy the benefits of a rudder system currently limited only to professional grade and custom-made paddleboards costing two to five times as much. Further, the remote control mechanism for the invention may be conveniently mounted on the paddle near the user's hand, allowing the paddleboard to be steered with only small movements of the thumb or finger. This invention allows the user to steer the paddleboard from any location on the board found to be most favorable for balance or maneuvering. In other embodiments, the controller may be mounted on the user's arm or wrist.

This invention has many advantages. It can be easily retrofitted onto most paddleboards on the market. It allows one to control the rudder direction without having to manually move the rudder. The remote control can removably attach to a paddle, wrist or forearm, making it easy to control the rudder. The disclosed rudder system is affordable and economically feasible to be used on lower cost paddleboards as well as top of the line paddleboards. The disclosed paddleboard rudder control system is less expensive than integrated rudder systems. The disclosed paddleboard rudder control system does not have to be manufactured into a paddleboard, but can be retrofitted on generally any board. The disclosed paddleboard rudder control system can be easily moved from paddleboard to paddleboard, convenient for owners of multiple boards and for travelling. As the rudder and rudder motor housing are independent of the mounting system, additional mounting systems may be manufactured to accommodate future paddleboard designs or other paddled watercraft, for example kayaks, canoes, inflatable rafts, etc. The controller allows user to manipulate board from any location on the board, and without changing foot location. Parents can use the controller to assist children in tracking straight; increasing safety and reducing frustration.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A paddleboard rudder control system comprising:

an attachment means, the attachment means comprising;

a tooth configured to slide into a fin box of a paddleboard;

a plurality of fasteners configured to attach the attachment means to a bottom of the paddleboard when the tooth is slid within the fin box of the paddleboard;

a rudder motor housing removably attached to the attachment means;

a rudder motor located within the rudder motor housing;

a rudder in rotatable communication with the rudder motor; and wherein each fastener comprises a screw configured to screw into the attachment means and through the tooth, with a washer located at a tooth end of the screw, and wherein when the screw is tightened the screw pulls down the washer against a wider portion of the fin box thereby attaching the attachment means to a bottom of the paddleboard.

2. The paddleboard rudder control system of claim 1 further comprising:

a circuit board located within the rudder motor housing and in signal communication with the motor;

a receiver located within the rudder motor housing, and in signal communication with the circuit board;

a battery located within the rudder motor housing, and in operable communication with the motor and the circuit board;

a controller configured to be removably attached to a user or a paddle, the controller comprising:

a controller housing;

a first direction button located on an exterior of the controller housing;

a second direction button located on the exterior of the controller housing;

a controller circuit board located within the controller housing, and in signal communication with the first direction button and the second direction button;

a transmitter located within the controller housing and in signal communication with the controller circuit board and with the receiver; and a battery located within the controller housing and in operable communication with the controller circuit board.

3. The paddleboard rudder control system of claim 2, wherein the controller further comprises:

a flexible strap attached to the controller housing;

a strap hook attached to the controller housing, and configured to removably attach to an end of the flexible strap such that the controller is removably attached to a paddle, user's wrist, or user's forearm.

4. The paddleboard rudder control system of claim 3, wherein the flexible strap comprises:

a plurality of hook slots each configured to attach to the strap hook;

an opening configured to be used as a handhold for a user when attaching the strap to his or her paddle, forearm, or wrist.

5. The paddleboard rudder control system of claim 2, wherein activating the first direction button causes the rudder to rotate counter-clockwise as viewed when looking down at the rudder motor housing with the rudder below the rudder motor housing, and wherein activating the second direction button causes the rudder to rotate clockwise as viewed when looking down at the rudder motor housing with the rudder below the rudder motor housing.

6. A paddleboard rudder control system comprising:

an attachment means, the attachment means comprising:

a tooth configured to slide into a fin box of a paddleboard;

a plurality of fasteners configured to attach the attachment means to a bottom of the paddleboard when the tooth is slid within the fin box of the paddleboard;

a rudder motor housing removably attached to the attachment means;

a rudder motor located within the rudder motor housing;

a rudder in rotatable communication with the rudder motor a circuit board located within the rudder motor housing and in signal communication with the motor;

a receiver located within the rudder motor housing, and in signal communication with the circuit board;

a battery located within the rudder motor housing, and in operable communication with the motor and the circuit board;

a controller configured to be removably attached to a user or a paddle, the controller comprising:

a controller housing;

a first direction button located on an exterior of the controller housing;

a second direction button located on the exterior of the controller housing;

a controller circuit board located within the controller housing, and in signal communication with the first direction button and the second direction button;

a transmitter located within the controller housing and in signal communication with the controller circuit board and with the receiver; and a battery located within the controller housing and in operable communication with the controller circuit board;

a first rudder motor housing pin located on an exterior of the rudder motor housing;

a second rudder motor housing pin located on the exterior of the rudder motor housing;

a bracket attached to a top of the attachment means, the bracket comprising:

a first slot, the first slot having a vertical portion and a horizontal portion located on a right side of the bracket;

a second slot, the second slot having a vertical portion and a horizontal portion located on a left side of the bracket;

a release lever configured to lock and unlock the rudder motor housing to the bracket; and wherein the first rudder motor housing pin is configured to slide across the horizontal portion of the first slot and down the vertical portion of the first slot when installing the rudder motor housing on the bracket, and wherein the second rudder motor housing pin is configured to slide across the horizontal portion of the second slot and down the vertical portion of the second slot when installing the rudder motor housing on the bracket.

7. A rudder control system for a watercraft comprising:

an attachment means, the attachment means comprising;

a tooth configured to slide into a fin box of a watercraft;

a plurality of fasteners configured to attach the attachment means to a bottom of the watercraft when the tooth is slid within the fin box of the watercraft;

a rudder motor housing removably attached to the attachment means;

a rudder motor located within the rudder motor housing;

a rudder in rotatable communication with the rudder motor; and wherein each fastener comprises a screw configured to screw into the attachment means and through the tooth, with a washer located at a tooth end of the screw, and wherein when the screw is tightened the screw nulls down the washer against a wider portion of the fin box thereby attaching the attachment means to a bottom of the paddleboard.

8. The rudder control system of claim 7 further comprising:

a circuit board located within the rudder motor housing and in signal communication with the motor;

a receiver located within the rudder motor housing, and in signal communication with the circuit board;

a battery located within the rudder motor housing, and in operable communication with the motor and the circuit board;

a controller configured to be removably attached to a user or a paddle, the controller comprising:

a controller housing;

a first direction button located on an exterior of the controller housing;

a second direction button located on the exterior of the controller housing;

a controller circuit board located within the controller housing, and in signal communication with the first direction button and the second direction button;

a transmitter located within the controller housing and in signal communication with the controller circuit board and with the receiver; and a battery located within the controller housing and in operable communication with the controller circuit board.

* * * * *